US009376277B2

(12) United States Patent
Ayash et al.

(10) Patent No.: US 9,376,277 B2
(45) Date of Patent: Jun. 28, 2016

(54) FOOT-ACTIVATED MEDIA SUPPLY DEVICES

(71) Applicant: XEROX CORPORATION, Norwalk, CT (US)

(72) Inventors: Barry K. Ayash, Webster, NY (US); Kevin J. St. Martin, Rochester, NY (US); Mark A. Rule, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 169 days.

(21) Appl. No.: 14/082,775

(22) Filed: Nov. 18, 2013

(65) Prior Publication Data

US 2015/0139757 A1 May 21, 2015

(51) Int. Cl.
*B65H 1/14* (2006.01)
*B65H 1/26* (2006.01)

(52) U.S. Cl.
CPC ..... *B65H 1/266* (2013.01); *B65H 1/14* (2013.01); *B65H 2405/12* (2013.01); *B65H 2405/15* (2013.01); *B65H 2407/20* (2013.01); *B65H 2601/322* (2013.01)

(58) Field of Classification Search
CPC ..... B65H 1/14; B65H 1/18; B65H 1/04; B65H 1/266
See application file for complete search history.

(56) References Cited

U.S. PATENT DOCUMENTS

| | | | |
|---|---|---|---|
| 1,231,747 A | 7/1917 | Krentner | |
| 1,671,715 A | 5/1928 | Gollnick et al. | |
| 2,375,793 A | 1/1943 | Kidrick et al. | |
| 2,483,203 A | 4/1944 | Janke | |
| 3,127,164 A | 3/1964 | Hoff | |
| 3,591,015 A | 7/1971 | d'Anka | |
| 3,866,901 A | 2/1975 | Brock | |
| 4,418,807 A | 12/1983 | Raines | |
| 5,040,777 A | 8/1991 | Bell et al. | |
| 5,157,448 A | 10/1992 | Lang | |
| 5,228,673 A | 7/1993 | Osonoe | |
| 7,290,777 B2 | 11/2007 | Preston et al. | |
| 8,348,259 B2 | 1/2013 | Marasco et al. | |
| 2009/0316193 A1 * | 12/2009 | Kohara | G03G 15/5016 358/1.15 |

FOREIGN PATENT DOCUMENTS

| | | | |
|---|---|---|---|
| JP | 08011391 A | * | 1/1996 |
| JP | 2003163770 A | * | 6/2003 |
| JP | 2007254133 A | * | 10/2007 |
| JP | 2012012174 A | * | 1/2012 |

* cited by examiner

*Primary Examiner* — Luis A Gonzalez
(74) *Attorney, Agent, or Firm* — Gibb & Riley, LLC

(57) ABSTRACT

A sheet supply device has a bottom contacting or resting on an external surface. The sheet supply device stores sheets of media and supplies the sheets of media to a processing device. The sheet supply device comprises a controller device, a platform supporting the sheets of media, and a foot-activated user input device positioned at the bottom of the sheet supply device adjacent the external surface. The platform moves upward (in a first direction away from the external surface) to supply the sheets of media to the processing device, and the platform moves downward (in a second direction toward the external surface) to allow the sheets of media to be loaded onto the platform. Operation of the foot-activated user input device causes the compartment to open and/or the platform to move downward (in the second direction).

20 Claims, 6 Drawing Sheets

FOOT-ACTIVATED MEDIA SUPPLY DEVICES

BACKGROUND

Systems and methods herein generally relate to sheet processing devices and more particularly to devices that utilize media storage elements to feed sheets of media into the sheet processing devices.

Common sheet processing devices include printers, copiers, multifunction devices (MFD), folding devices, stapling devices, bookmaking devices, cutting devices, punching devices, etc. These types of devices process stacks of sheets of media that are generally contained within some type of mechanism that feeds sheets of media into the processing device.

One issue arises with such devices occurs when the user needs to replenish the stack of media sheets. Many times the user may inadvertently forget to open the drawer or door needed to access the platform upon which the media sheets are stacked. In this situation, the user may need to place the stack of sheets down in one location while they return to the processing device to open the forgotten door or drawer before being able to continue with the media replenishment operation.

This operation of having the user put the stack of sheets down in order to open the drawer or door can be wasteful with respect to the user's time, and may cause some of the sheets of media to be damaged or may cause the stack of sheets of media to become misaligned.

SUMMARY

An exemplary sheet supply device herein (which can be a stand-alone device or a component of a larger, more complex machine) has a bottom contacting or resting on an external surface, such as the floor or a stand. The sheet supply device stores sheets of media and supplies the sheets of media to a processing device. The sheet supply device comprises a controller device, a platform within a compartment of the sheet supply device (the platform supports the sheets of media) and a foot-activated user input device positioned at the bottom of the sheet supply device adjacent the external surface. The platform moves upward (in a first direction away from the external surface) to supply the sheets of media to the processing device, and the platform moves downward (in a second direction toward the external surface) to allow the sheets of media to be loaded onto the platform. Operation of the foot-activated user input device causes the compartment to open and/or the platform to move downward (in the second direction).

More elaborate exemplary processing apparatuses herein also have a bottom that contacts or rests on an external surface. For example, these devices can include a printing device, a cutting device, a punching device, an alignment device, a stapling device, a bookmaking device, and/or a laminating device, etc.

Various components, such as a controller device, a sheet processing device, a sheet supply device, etc., are operatively (meaning directly or indirectly) connected to one another and can be integral parts of the processing apparatuses. Such components are positioned above the bottom of the processing apparatuses (the bottom of each processing apparatus separates such components from the external surface). The sheet processing device alters the sheets of media, and the sheet supply device stores the sheets of media and supplies the sheets of media to the sheet processing device.

More specifically, the sheet supply device includes a platform within a compartment of the processing apparatus that is also operatively connected to the controller device. The platform supports the sheets of media. The platform moves upward (in a first direction away from the external surface) to supply the sheets of media to the processing device, and the platform moves downward (in a second direction toward the external surface) to allow the sheets of media to be loaded onto the platform. Further, the sheet supply device includes a sheet feeder device positioned toward the top of the sheet supply device (opposite the bottom) and the platform moves toward the sheet feeder device when moving in the first direction.

In addition, the processing apparatuses herein include a foot-activated user input device that is also operatively connected to the controller device and is positioned at the bottom of the apparatuses (adjacent the external surface). Operation of the foot-activated user input device causes the compartment to open and/or the platform to move downward (in the second direction), and in some devices, a single operation of the foot-activated user input device causes the compartment to open and the platform to move downward into a position fully extended toward the bottom of the sheet supply device.

Also, if the processing apparatus includes a plurality of platforms within a plurality of compartments, the foot-activated user input device can also comprise a plurality of foot-activated user input devices. Each of the foot-activated user input devices corresponds to one of the platforms and associated compartment.

More specifically, the foot-activated user input device can be a foot pedal, a foot switch, a foot-activated button, a foot-activated sonic sensor, a foot-activated optical sensor, a foot-activated radar sensor, etc. The foot-activated user input device is positioned at the bottom of the device very close to the floor (external surface) and can be, for example, within 40 cm of the external surface to allow the user to easily access and operate the foot-activated user input device with their feet.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, it can be inconvenient or wasteful if a user is required to temporarily place a stack of sheets of media down while the user opens a drawer or door that the user forgot to open when performing a media replenishment operation on a media processing device. In view of this, the devices herein provide apparatuses with a foot-operated device (referred to herein as a foot-operated user interface) that will cause the drawer or door to open (and potentially cause the platform or elevator upon which the sheets are placed to lower). By providing the user with a foot-operated user interface, the devices herein avoid the situation of having the user temporarily place the stack of sheets of media down while they open the drawer or door where the media sheet feeder is located.

Figure 1:
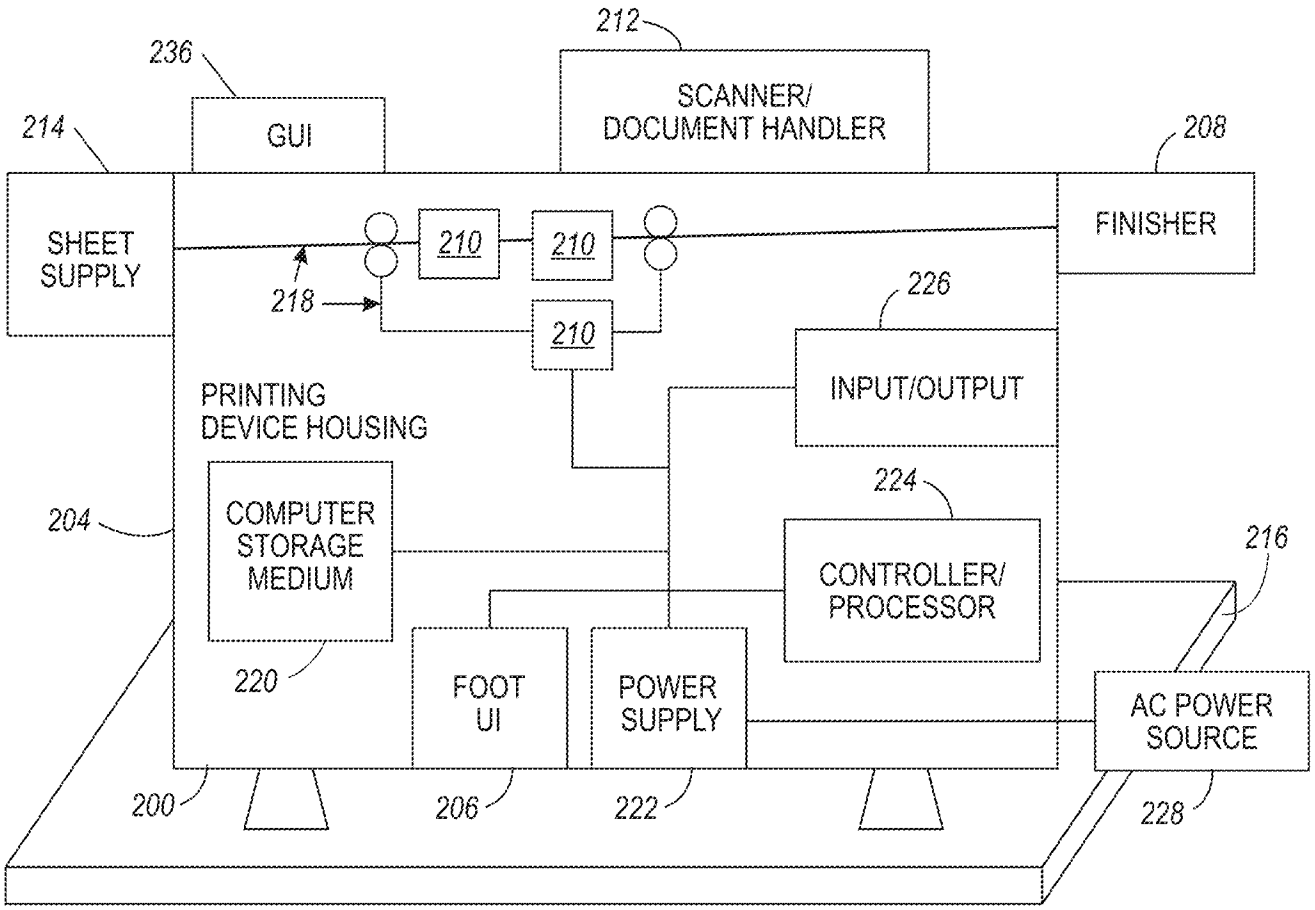
FIG. 1 is a schematic diagram illustrating devices herein.

FIG. 1 illustrates an exemplary device 204, which can be used with systems and methods herein and can comprise, for example, a printer, copier, multi-function machine, multi-function device (MFD), a cutting device, a punching device, an alignment device, a stapling device, a bookmaking device, and/or a laminating device, etc.

The device 204 has a bottom 200 that contacts or rests on an external surface (such as the floor, the ground, or a platform) 216. In the illustrated structure, the feet of the bottom 200 are resting on the floor 216 (where gravity holds the device 204 against the floor). However, the device could be on another surface such as a shelf or support and could be bolted or otherwise attached to the external surface 216.

A foot-activated user input device (foot UI) 206, that is also operatively connected to the controller device, is positioned at the bottom 200 of the apparatuses (adjacent the external surface 216). More specifically, the foot-activated user input device 206 can be a foot pedal, a foot switch, a foot-activated button, a foot-activated sonic sensor, a foot-activated optical sensor, a foot-activated radar sensor, etc. The foot-activated user input device 206 is positioned at the bottom 200 of the device very close to the floor (external surface 216) and can be, for example, within 40 cm, within 25 cm, within 10 cm, etc. (or any other measure, depending upon implementation) of the external surface 216 to allow the user to easily access and operate the foot-activated user input device 206 with their feet or other similar extremity.

With respect to the foot-activated user input device 206, foot pedals, foot switches, and foot-activated buttons, etc., are operated or activated by the user actually contacting the device; while foot-activated sonic sensors, foot-activated optical sensors, foot-activated radar sensors, etc., are operated or activated by the user passing or waving (moving back and forth) their foot within the field of view (or within the range of detection) of such devices. The details of such devices are well known by those ordinarily skilled in the art and are available from various vendors and, therefore, the details of such devices are not discussed herein to focus the reader on the salient features of this disclosure.

The sensitivity of the foot-activated user input device 206 is adjusted to operate consistently and reliably with how average users provide foot movement. Further, while the user's "foot" is described as the element that operates the foot-activated user input device 206, those ordinarily skilled in the art would understand that any element (such as a users cane, the wheel of a users wheelchair, the users hand, etc.) could be utilized to operate the foot-activated user input device 206. However, the foot-activated user input device 206 is located in a position to allow a user's foot to be the most convenient item that operates the foot-activated user input device 206.

Further the device 204 includes a controller/processor 224 and a communications port (input/output) 226 operatively connected to the processor 224 and to a computerized network external to the device 204. Also, the device 204 can include at least one accessory functional component, such as a graphic user interface assembly 236 that also operate on the power supplied from the external power source 228 (through the power supply 222).

The input/output device 226 is used for communications to and from the device 204. The processor 224 controls the various actions of the device 204. A non-transitory computer storage medium device 220 (which can be optical, magnetic, capacitor based, etc.) is readable by the processor 224 and stores instructions that the processor 224 executes to allow the computerized device to perform its various functions, such as those described herein. Thus, as shown in FIG. 1, a body housing 204 has one or more functional components that operate on power supplied from an alternating current (AC) source 228 by the power supply 222. The power supply 222 can comprise a power storage element (e.g., a battery, etc).

The device 204 includes at least one sheet processing device (such as marking device (printing engines), cutting devices, punching devices, folding devices, stapling devices, etc., 210 operatively connected to the processor 224, a media path 218 positioned to supply sheets of media from a sheet supply 214 to the processing device(s) 210, etc. After being physically changed by the processing devices 210, the sheets of media can optionally pass to a finisher 208 which can fold, staple, sort, etc., the various printed sheets (if such processing operations are not already performed by the processing devices 210). Also, the device 204 can include at least one accessory functional component (such as a scanner/document handler 212, etc.) that also operates on the power supplied from the external power source 228 (through the power supply 222).

Thus, various components, such as a controller device 224, a sheet processing device 210, a sheet supply device 214, etc., are operatively (meaning directly or indirectly) connected to one another and can be integral parts of the processing apparatuses 204. Such components are positioned above the bottom 200 of the processing apparatuses 204 (the bottom 200 of each processing apparatus 204 separates such components from the external surface 216). The sheet processing device 210 alters the sheets of media, and the sheet supply device 214 stores the sheets of media and supplies the sheets of media to the sheet processing device 210.

Figure 2:
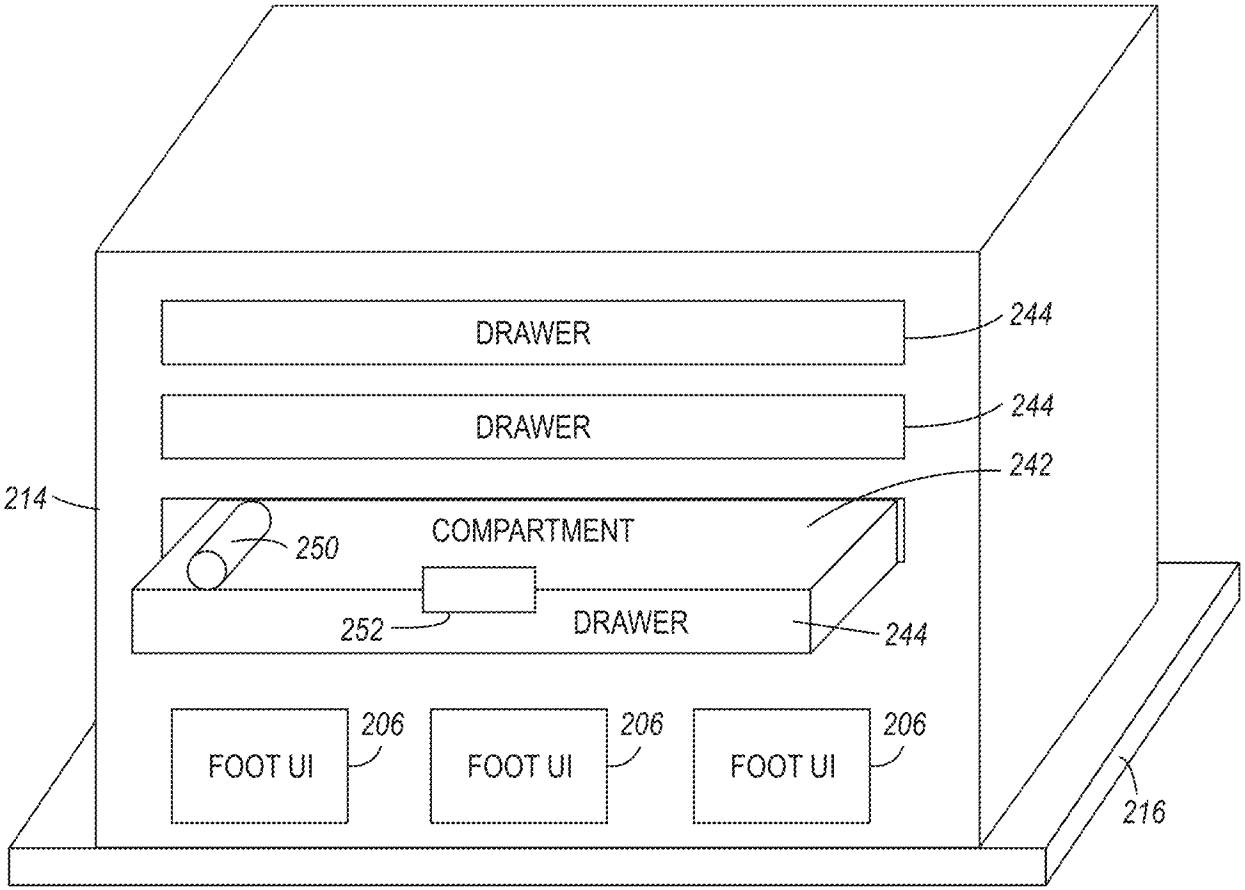
FIG. 2 is a schematic diagram illustrating devices herein.

Aspects of the sheet supply device 214 are shown in greater detail in FIGS. 2-6. As shown in FIG. 2, the sheet supply device 214 (which can be a stand-alone element or part of a more complex structure 204) can include one or more drawers 244 each of which contains a tray or other type of compartment 242.

As shown in FIG. 2, if the sheet supply device 214 includes multiple drawers, the sheet supply device 214 (or the processing apparatus 204) can include multiple foot-operated user interface devices 206. In this example, each different foot-operated user interface device 206 can control only one of the drawers 244. When the user moves their foot in a detection range of one of the foot-operated user interfaces 204 or presses on one of the foot-operated user interfaces 206, this is considered to be the user "operating" the foot-operated user interface 206. When one of the foot-operated user interfaces 206 is operated by the user, a corresponding drawer 244 will automatically open (and, as discussed in detail below, a platform tray can automatically lower).

Alternatively, a single foot-operated user interface 206 can be used with multiple drawers 244 (or doors 246, mentioned below). An operation of such a single foot-operated user interface 206 can cause all drawers to simultaneously open. Alternatively, operation of such a single foot-operated user interface can successively open the drawers 244 beginning, for example, with the lowest drawer and progressing upwards toward the top drawer until all drawers are successively opened.

Figure 3:
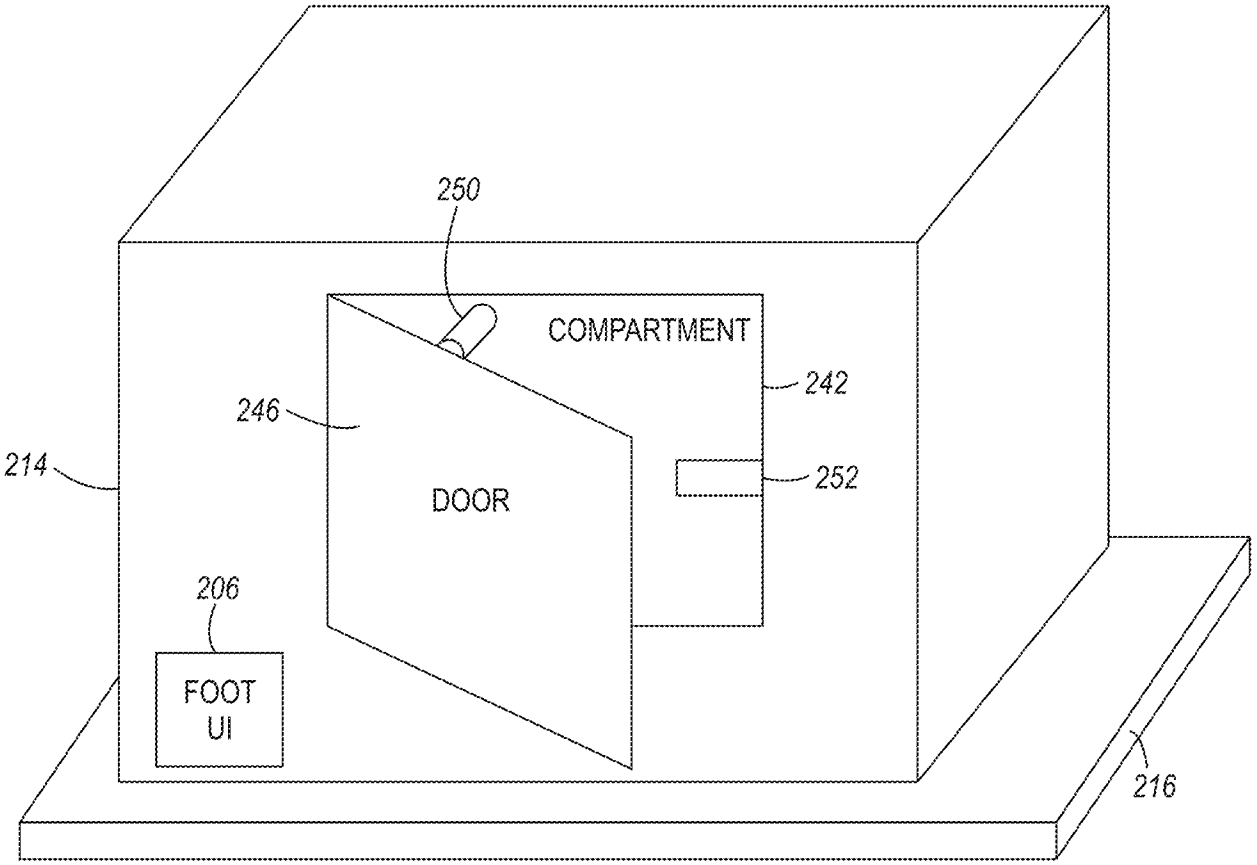
FIG. 3 is a schematic diagram illustrating devices herein.

As alternatively shown in FIG. 3, the compartment 242 can be located behind a door 246 or other similar cover to an opening within the sheet supply device 214. In other alternatives, the elements shown within the compartment 242 can be external to the processing apparatus 204 and do not need to be contained within a compartment 242. Again, operation of the foot-operated user interface 206 by the user's foot causes the door 246 to automatically open (and potentially causes an elevated tray or platform to automatically lower).

A number of different mechanisms can be utilized to cause the drawers 244 or door 246 to automatically open in response only to the user operating the foot-operated user interface 206. For example, electronic, pneumatic, hydraulic, etc., actuators 250 can be attached to the drawers 244 or door 246, and such actuators 250 can receive a signal to open the drawers 244 or door 246 from the processor 224 when the processor 224 detects operation of the foot-operated user interface 206. Alternatively, springs, rubber bands, gas compression cylinders, or other self-contained potential energy storage devices (also represented by item 250) can be attached to the drawers 244 and door 246. Such energy storage devices 250 become loaded with potential energy (are placed under tension) as the drawers 244 or door 246 are moved into the closed position by the user. A powered latch 252 holds the drawers 244 or door 246 closed. The powered latch 252 can similarly contain actuators, such as those mentioned above. Then, when the processor detects operation of the foot-operated user interface 206, the processor sends a signal to the powered latch 252 to release, and the energy storage devices 250 move the drawers 244 or door 246 into the opened position.

Thus, as shown above, the compartment 242 can be a space within a drawer 244 or a space covered with a door 246 within a standalone sheet supply device 214 or a more complex processing apparatus 204. The details of the compartment 242 are shown generically in FIGS. 4-6. The compartment 242 can include a platform 240 that holds sheets of media 256 that are to be fed into the processing apparatus 204. Items 254 represent feeder devices that feed the sheets of media 256 from the platform 240 into the processing apparatus 204.

Figure 4:
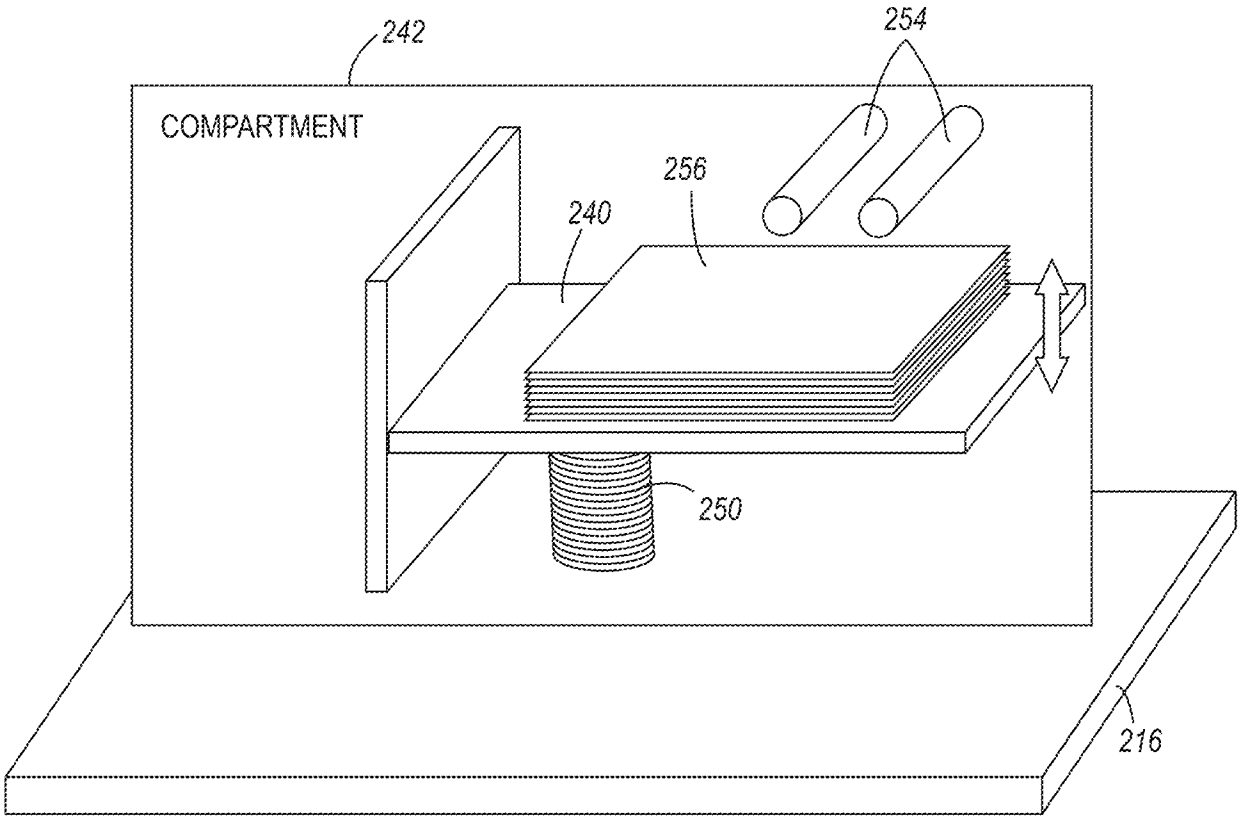
FIG. 4 is a schematic diagram illustrating devices herein.
Figure 5:
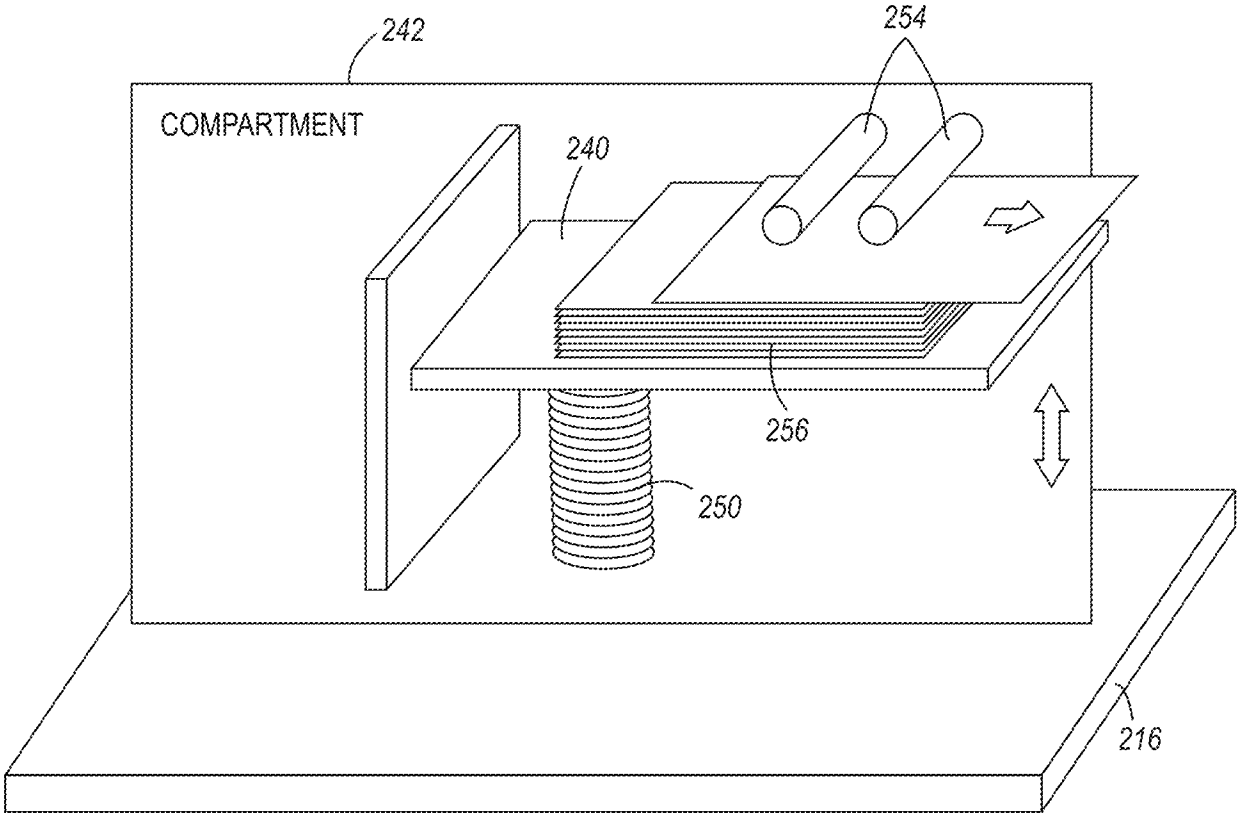
FIG. 5 is a schematic diagram illustrating devices herein.
Figure 6:
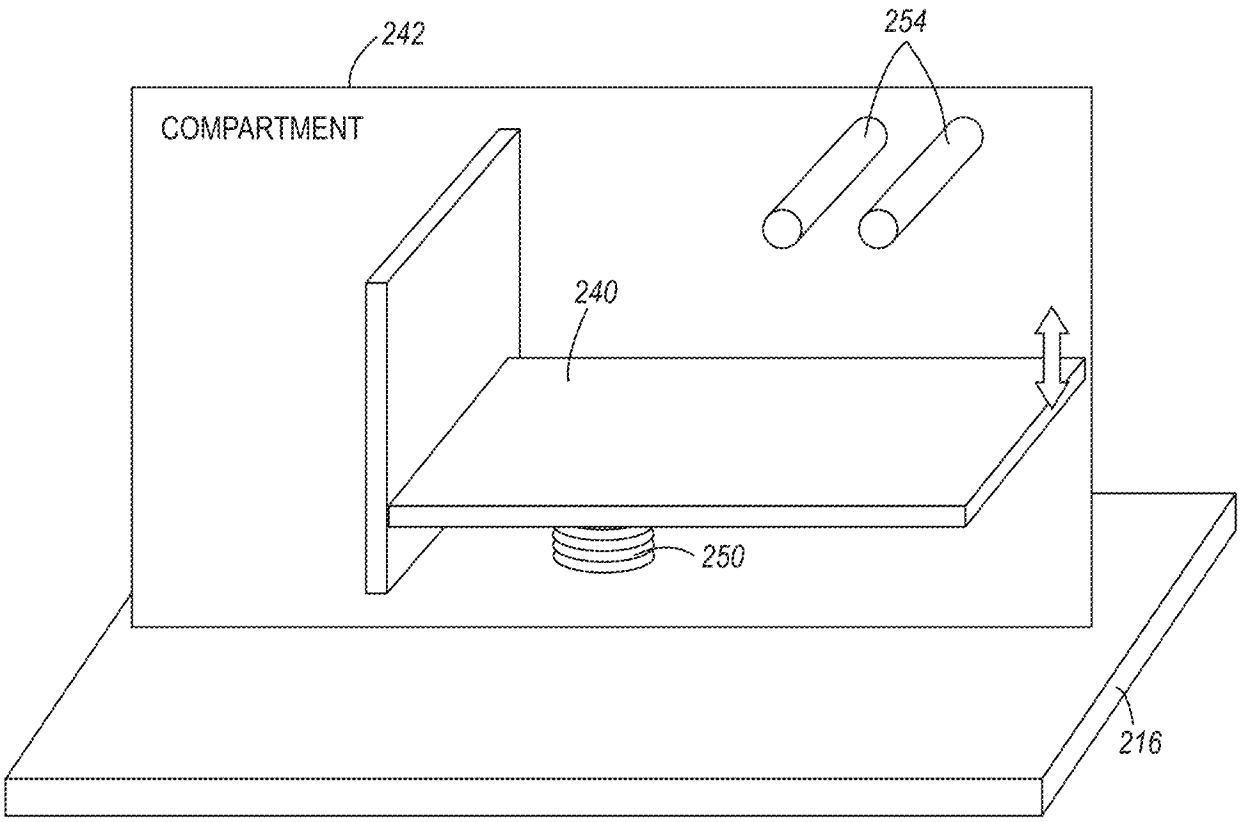
FIG. 6 is a schematic diagram illustrating devices herein.

While one arrangement is shown in FIGS. 4-6, those ordinarily skilled in the art would understand that many other arrangements of the compartment 242 could be utilized by devices herein, and that the arrangement shown in FIGS. 4-6 is only used for illustration purposes and the claims provided below are not limited to the specific arrangement shown in FIGS. 4-6. To the contrary, each specific device can utilize more components or less components, and the components can be arranged in different positions from that shown in FIGS. 4-6.

For example, the platform 240 can comprise a frame and an elevator that are moved upwards and downwards using powered actuators or self-contained energy storage devices (both represented by item 250). Therefore, in one example, the platform 240 can be a simple spring-loaded platform; while in other situations, the platform 240 can be moved by electrical motors or other powered actuators 250. Those ordinarily skilled in the art would understand that many other arrangements and devices are possible with such structures.

Thus, as shown in FIGS. 4-6, the sheet supply device 214 includes a platform 240, potentially within a compartment 242. The platform 240, drawers 244, and door(s) 246 are also operatively connected to the controller device 224. FIG. 4 illustrates the platform 240 in a somewhat central position.

As noted above, the sheet supply device 214 includes a sheet feeder device 254 positioned toward the top of the sheet supply device 214 (opposite the bottom 200 and external surface 216) and the platform 240 moves toward the sheet feeder device when moving upward. As shown in FIG. 5, the platform 240 moves upward (in the first direction away from the external surface 216) to cause the sheets of media 256 to contact the feed rollers 254. The feed rollers 254 move the sheets of media 256 from the platform 240 to supply the sheets of media 256 to the processing device 204.

In order to allow the user to load more sheets of media 256 on the platform 240, the platform 240 moves downward (in a second direction toward the external surface 216) as shown in FIG. 6. Again, this downward movement of the platform 240 can be caused by powered devices (such as actuators 250) or can be caused by the weight of the media pressing downward against self-contained potential energy storage devices 250. In some devices (those using the powered actuators 250) the platform 240 moves downward as the drawer 244 moves open; and in other situations (those using the self-contained potential energy storage devices 250) the drawer 244 opens, allowing the user to place sheets of media 256 on the platform 240 and the weight of the sheets of media 256 causes the platform 240 to lower.

As noted above, operation of the foot-activated user input device 206 causes the compartment 242 to open and/or the platform 240 to move downward (in the second direction), and in some devices, a single operation of the foot-activated user input device 206 causes the compartment to open and the platform 240 to move downward into a position fully extended toward the bottom 200 of the sheet supply device 214.

Also, if the processing apparatus includes a plurality of compartments 242 and platforms 240, the foot-activated user input device 206 can comprise a plurality of foot-activated user input devices 206, and each of the foot-activated user input devices 206 corresponds to one of the platforms 240 and associated compartment 242 drawers 244 or doors 246.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a sheet supply device having a bottom, said bottom contacting an external surface, said sheet supply device storing sheets of media and supplying said sheets of media to a processing device, said sheet supply device comprising:

a controller device;

a platform within a compartment of said sheet supply device, said platform supporting said sheets of media and being operatively connected to said controller device, said platform moving in a first direction away from said external surface to supply said sheets of media to said processing device, and said platform moving in a second direction toward said external surface to allow said sheets of media to be loaded onto said platform; and a movement-activated user input device operatively connected to said controller device and being positioned at said bottom of said sheet supply device adjacent said external surface, said movement-activated user input device comprising one of a foot-activated sonic sensor and a foot-activated radar sensor, said movement-activated user input device being operated by a user waving a foot, by moving said foot back and forth, within a range of detection of said movement-activated user input device, and operation of said movement-activated user input device causing:

said compartment to open; and said platform to move in said second direction.

2. The apparatus according to claim 1, said movement-activated user input device being positioned at said bottom of said sheet supply device to be within 40 cm of said external surface.

3. The apparatus according to claim 1, said sheet supply device further comprising a sheet feeder device positioned opposite said bottom, said platform moving toward said sheet feeder device when moving in said first direction.

4. The apparatus according to claim 1, said platform comprising a plurality of platforms within a plurality of compartments, said movement-activated user input device comprising a plurality of foot-activated user input devices, and each of said foot-activated user input devices corresponding to one of said platforms and said compartments.

5. The apparatus according to claim 1, said platform comprising a plurality of platforms within a plurality of compartments, and successive operations of said movement-activated user input device successively causing each of said compartment to open and said platforms to move in said second direction beginning with a lowest platform and progressing upwards toward a top platform.

6. An apparatus comprising:

a sheet supply device having a bottom, said bottom contacting an external surface, said sheet supply device storing sheets of media and supplying said sheets of media to a processing device, said sheet supply device comprising:

a controller device;

a platform within a compartment of said sheet supply device, said platform supporting said sheets of media and being operatively connected to said controller device, said platform moving in a first direction away from said external surface to supply said sheets of media to said processing device, and said platform moving in a second direction toward said external surface to allow said sheets of media to be loaded onto said platform; and a movement-activated user input device operatively connected to said controller device and being positioned at said bottom of said sheet supply device adjacent said external surface, said movement-activated user input device comprising one of a foot-activated sonic sensor and a foot-activated radar sensor, said movement-activated user input device being operated by a user waving a foot, by moving said foot back and forth, within a range of detection of said movement-activated user input device, and a single operation of said movement-activated user input device causing:

said compartment to open; and said platform to move in said second direction into a position fully extended toward said bottom of said sheet supply device.

7. The apparatus according to claim 6, said movement-activated user input device being positioned at said bottom of said sheet supply device to be within 40 cm of said external surface.

8. The apparatus according to claim 6, said sheet supply device further comprising a sheet feeder device positioned opposite said bottom, said platform moving toward said sheet feeder device when moving in said first direction.

9. The apparatus according to claim 6, said platform comprising a plurality of platforms within a plurality of compartments, said movement-activated user input device comprising a plurality of foot-activated user input devices, and each of said foot-activated user input devices corresponding to one of said platforms and said compartments.

10. The apparatus according to claim 6, said platform comprising a plurality of platforms within a plurality of compartments, and successive operations of said movement-activated user input device successively causing each of said compartment to open and said platforms to move in said second direction beginning with a lowest platform and progressing upwards toward a top platform.

11. A processing apparatus comprising:

a bottom, said bottom contacting an external surface;

a controller device, said bottom being positioned between said controller device and said external surface;

a sheet processing device operatively connected to said controller device, said bottom being positioned between said sheet processing device and said external surface, and said sheet processing device altering sheets of media;

a sheet supply device operatively connected to said controller device, said bottom being positioned between said sheet supply device and said external surface, said sheet supply device storing said sheets of media and supplying said sheets of media to said sheet processing device; and a movement-activated user input device operatively connected to said controller device and being positioned at said bottom adjacent said external surface, said movement-activated user input device comprising one of a foot-activated sonic sensor and a foot-activated radar sensor, said movement-activated user input device being operated by a user waving a foot, by moving said foot back and forth, within a range of detection of said movement-activated user input device, said sheet supply device comprising a platform within a compartment of said processing apparatus, said platform supporting said sheets of media and being operatively connected to said controller device, said platform moving in a first direction away from said external surface to supply said sheets of media to said sheet processing device, and said platform moving in a second direction toward said external surface to allow said sheets of media to be loaded onto said platform, and operation of said movement-activated user input device causing at least one of:

said compartment to open; and said platform to move in said second direction.

12. The apparatus according to claim 11, said movement-activated user input device being positioned at said bottom to be within 40 cm of said external surface.

13. The apparatus according to claim 11, said sheet supply device further comprising a sheet feeder device positioned opposite said bottom, said platform moving toward said sheet feeder device when moving in said first direction.

14. The apparatus according to claim 11, said platform comprising a plurality of platforms within a plurality of compartments, said movement-activated user input device comprising a plurality of foot-activated user input devices, and each of said foot-activated user input devices corresponding to one of said platforms and said compartments.

15. The apparatus according to claim 11, said platform comprising a plurality of platforms within a plurality of compartments, and successive operations of said movement-activated user input device successively causing each of said compartment to open and said platforms to move in said second direction beginning with a lowest platform and progressing upwards toward a top platform.

16. A processing apparatus comprising:

a bottom, said bottom contacting an external surface;

a controller device, said bottom being positioned between said controller device and said external surface;

a sheet processing device operatively connected to said controller device, said bottom being positioned between said sheet processing device and said external surface, and said sheet processing device altering sheets of media;

a sheet supply device operatively connected to said controller device, said bottom being positioned between said sheet supply device and said external surface, said sheet supply device storing said sheets of media and supplying said sheets of media to said sheet processing device; and a movement-activated user input device operatively connected to said controller device and being positioned at said bottom adjacent said external surface, said movement-activated user input device comprising one of a foot-activated sonic sensor and a foot-activated radar sensor, said movement-activated user input device being operated by a user waving a foot, by moving said foot back and forth, within a range of detection of said movement-activated user input device, said sheet supply device comprising a platform within a compartment of said processing apparatus, said platform supporting said sheets of media and being operatively connected to said controller device, said platform moving in a first direction away from said external surface to supply said sheets of media to said sheet processing device, and said platform moving in a second direction toward said external surface to allow said sheets of media to be loaded onto said platform, and a single operation of said movement-activated user input device causing:

said compartment to open; and said platform to move in said second direction into a position fully extended toward said bottom of said sheet supply device.

17. The apparatus according to claim 16, said movement-activated user input device being positioned at said bottom to be within 40 cm of said external surface.

18. The apparatus according to claim 16, said sheet supply device further comprising a sheet feeder device positioned opposite said bottom, said platform moving toward said sheet feeder device when moving in said first direction.

19. The apparatus according to claim 16, said platform comprising a plurality of platforms within a plurality of compartments, said movement-activated user input device comprising a plurality of foot-activated user input devices, and each of said foot-activated user input devices corresponding to one of said platforms and said compartments.

20. The apparatus according to claim 16, said platform comprising a plurality of platforms within a plurality of compartments, and successive operations of said movement-activated user input device successively causing each of said compartment to open and said platforms to move in said second direction beginning with a lowest platform and progressing upwards toward a top platform.

* * * * *